US007013979B2

(12) United States Patent
Richard

(10) Patent No.: US 7,013,979 B2
(45) **Date of Patent: *Mar. 21, 2006**

(54) SELF-CONFORMING SCREEN

(75) Inventor: Bennett M. Richard, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/102,034

(22) Filed: Apr. 8, 2005

(65) Prior Publication Data

US 2005/0173130 A1 Aug. 11, 2005

Related U.S. Application Data

(63) Continuation of application No. 10/226,941, filed on Aug. 23, 2002.

(51) Int. Cl.
*E21B 43/08* (2006.01)

(52) U.S. Cl. ..... 166/369; 166/207; 166/227; 166/380

(58) Field of Classification Search ..... 166/369, 166/382, 380, 206, 207, 227
See application file for complete search history.

(56) References Cited

U.S. PATENT DOCUMENTS

| | | | | |
|---|---|---|---|---|
| 2,942,668 A | | 6/1960 | Maly et al. | |
| 2,981,332 A | | 4/1961 | Miller et al. | |
| 2,981,333 A | | 4/1961 | Miller et al. | |
| 3,099,318 A | | 7/1963 | Miller et al. | |
| 3,385,367 A | * | 5/1968 | Kollsman | 166/191 |
| 3,477,506 A | | 11/1969 | Malone | |
| 3,918,523 A | * | 11/1975 | Stuber | 166/285 |
| 4,137,970 A | * | 2/1979 | Laflin et al. | 166/292 |
| 4,262,744 A | | 4/1981 | Mitchell et al. | |
| 4,919,989 A | * | 4/1990 | Colangelo | 428/66.4 |
| 4,936,386 A | * | 6/1990 | Colangelo | 166/292 |
| 5,667,011 A | | 9/1997 | Gill et al. | |
| 5,901,789 A | | 5/1999 | Donnelly et al. | |
| 6,012,522 A | | 1/2000 | Donnelly et al. | |
| 6,213,209 B1 | | 4/2001 | Nguyen et al. | |
| 6,250,385 B1 | | 6/2001 | Montaron | |
| 6,253,850 B1 | | 7/2001 | Nazzai et al. | |
| 6,263,966 B1 | | 7/2001 | Haut et al. | |
| 6,302,207 B1 | | 10/2001 | Nguyen et al. | |
| 6,431,282 B1 | | 8/2002 | Bosma et al. | |
| 6,530,431 B1 | | 3/2003 | Castano-Mears et al. | |
| 6,543,545 B1 | | 4/2003 | Chatterji et al. | |

(Continued)

FOREIGN PATENT DOCUMENTS

GB 2347446 A 9/2000

(Continued)

*Primary Examiner*—Hoang Dang
(74) *Attorney, Agent, or Firm*—Steve Rosenblatt

(57) ABSTRACT

A screen that conforms to the borehole shape after expansion is disclosed. The screen comprises a compliant outer layer that takes the borehole shape on expansion. The outer layer is formed having holes to permit production flow. The material that is selected preferably swells with prolonged contact to well fluids to further close off annular gaps after expansion. In an alternative embodiment, the screen is not expanded and the swelling of the material alone closes off annular gaps. The outer sleeve is placed over the screen and the screen is placed on a base pipe and initially expanded from within the base pipe to secure the components of the screen assembly for running downhole, while minimizing or eliminating any welding among the layers. A variety of expansion tools can be used to expand the screen or screens downhole.

15 Claims, 2 Drawing Sheets

U.S. PATENT DOCUMENTS

| | | | | |
|---|---|---|---|---|
| 6,668,928 | B1 | 12/2003 | Brothers | |
| 6,769,484 | B1 | 8/2004 | Longmore | |
| 2002/0084070 | A1 | 7/2002 | Voll et al. | |
| 2003/0075323 | A1 | 4/2003 | Vercaemer et al. | |
| 2003/0136562 | A1 | 7/2003 | Robison et al. | |
| 2004/0164499 | A1 | 8/2004 | Murakami et al. | |
| 2004/0194971 | A1 * | 10/2004 | Thomson | 166/387 |
| 2004/0261990 | A1 * | 12/2004 | Bosma et al. | 166/50 |

FOREIGN PATENT DOCUMENTS

| | | | |
|---|---|---|---|
| WO | WO 00/39432 | | 7/2000 |
| WO | WO 00/61914 | * | 10/2000 |
| WO | WO 02/059452 | * | 8/2002 |

* cited by examiner

SELF-CONFORMING SCREEN

PRIORITY INFORMATION

This application is a continuation of U.S. patent application Ser. No. 10/226,941, filed on Aug. 23, 2002.

FIELD OF THE INVENTION

The field of this invention is downhole screens and more particularly those that can be expanded in open hole to close off an irregularly shaped borehole.

BACKGROUND OF THE INVENTION

In the past sand control methods have been dominated by gravel packing outside of downhole screens. The idea was to fill the annular space outside the screen with sand to prevent the production of undesirable solids from the formation. More recently, with the advent of tubular expansion technology, it was thought that the need for gravel packing could be eliminated if a screen or screens could be expanded in place to eliminate the surrounding annular space that had heretofore been packed with sand. Problems arose with the screen expansion technique as a replacement for gravel packing because of wellbore shape irregularities. A fixed swage would expand a screen a fixed amount. The problems were that a washout in the wellbore would still leave a large annular space outside the screen. Conversely, a tight spot in the wellbore could create the risk of sticking the fixed swage.

One improvement of the fixed swage technique was to use various forms of flexible swages. In theory these flexible swages were compliant so that in a tight spot they would flex inwardly and reduce the chance of sticking the swage. On the other hand, if there was a void area, the same problem persisted in that the flexible swage had a finite outer dimension to which it would expand the screen. Therefore, the use of flexible swages still left the problem of annular gaps outside the screen with a resulting undesired production of solids when the well was put on production from that zone.

Prior designs of screens have used pre-compressed mat held by a metal sheath that is then subjected to a chemical attack when placed in the desired location downhole. The mat is then allowed to expand from its pre-compressed state. The screen is not expanded. This design is described in U.S. Pat. Nos. 2,981,332 and 2.981,333. U.S. Pat. No. 5,667,011 shows a fixed swage expanding a slotted liner downhole. U.S. Pat. Nos. 5,901,789 and 6,012,522 show well screens being expanded. U.S. Pat. No. 6,253,850 shows a technique of inserting one solid liner in another already expanded slotted liner to blank it off and the used of rubber or epoxies to seal between the liners. U.S. Pat. No. 6,263,966 shows a screen with longitudinal pleats being expanded downhole. U.S. Pat. No. 5,833,001 shows rubber cured in place to make a patch after being expanded with an inflatable. Finally, U.S. Pat. No. 4,262,744 is of general interest as a technique for making screens using molds.

The apparatus and method of the present invention addresses this issue by providing a screen assembly with an outer layer that can conform to the borehole shape upon expansion. In the preferred embodiment the material is selected that will swell in contact with wellbore fluids to further promote filling the void areas in the borehole after expansion. In an alternative design, screen expansion is not required and the outermost layer swells to conform to the borehole shape from contact with well fluids or other fluids introduced into the wellbore. The screen section is fabricated in a manner that reduces or eliminates welds. Welds are placed under severe loading in an expansion process, so minimizing or eliminating welds provides for more reliable screen operation after expansion. These and other advantages of the present invention will become more apparent to one skilled in the art from a review of the description of the preferred embodiment and the claims that appear below.

SUMMARY OF THE INVENTION

A screen that conforms to the borehole shape after expansion is disclosed. The screen comprises a compliant outer layer that takes the borehole shape on expansion. The outer layer is formed having holes to permit production flow. The material that is selected preferably swells with prolonged contact to well fluids to further close off annular gaps after expansion. In an alternative embodiment, the screen is not expanded and the swelling of the material alone closes off annular gaps. The outer sleeve is placed over the screen and the screen is placed on a base pipe and initially expanded from within the base pipe to secure the components of the screen assembly for running downhole, while minimizing or eliminating any welding among the layers. A variety of expansion tools can be used to expand the screen or screens downhole.

DETAILED DESCRIPTION OF THE PREFERRED EMBODIMENT

Figure 1:
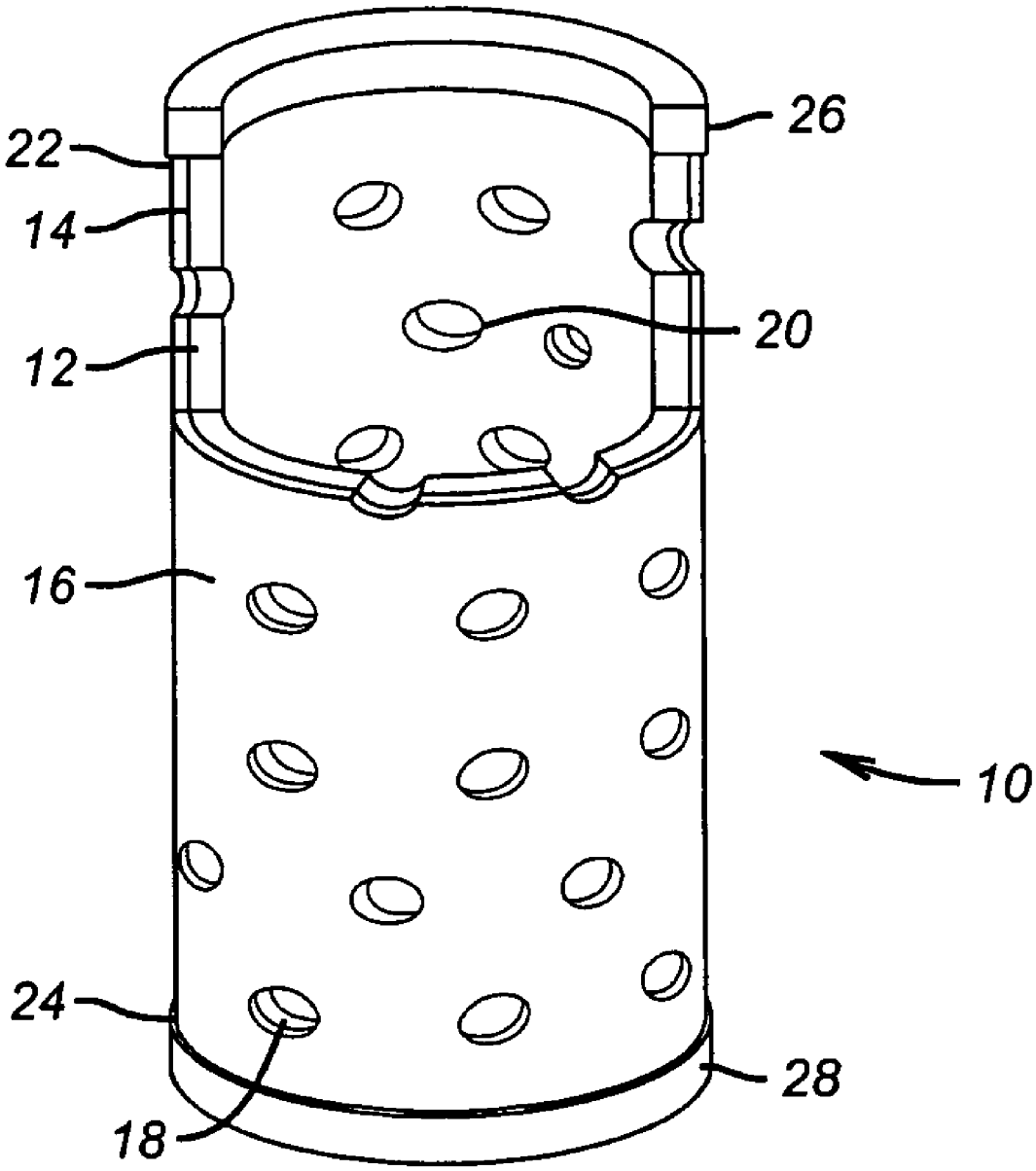
FIG. 1 is a cutaway view of the screen shown in elevation.

FIG. 1 illustrates a portion of a section of screen 10. It has a base pipe 12 over which is the screen 14 and over which is outer conforming layer 16. Layer 16 has a plurality of holes 18. The base pipe 12 also has holes 20. The actual filter material or screen 14 can be a mesh or a weave or other known filtration products. The conforming layer 16 is preferably soft so, that it will flow upon expansion of the screen 10. The preferred material is one that will swell when exposed to well fluids for an extended period of time. Three examples are nitrile, natural rubber, and AFLAS. In an alternative embodiment, the conforming layer 16 swells sufficiently after being run into the wellbore, to contact the wellbore, without expansion of the screen 10. Shown schematically at the ends 22 and 24 of screen 10 are stop rings 26 and 28. These stop rings will contain the conforming layer 16 upon expansion of screen 10 against running longitudinally in an annular space outside screen 10 after it is expanded. Their use is optional.

The manner of assembly of the screen 10 is another aspect of the invention. The conforming layer 16 can have an internal diameter that allows it to be slipped over the screen material 14. The assembly of the screen material 14 and the conforming layer 16 are slipped over the base pipe 12. Thereafter, a known expansion tool is applied internally to base pipe 12 to slightly expand it. As a result, the screen material 14 and the conforming layer 16 are both secured to the base pipe 12 without need for welding. This is advantageous because when the screen 10 is run in the wellbore and expanded, the expansion process can put large stresses on welds that may cause screen failure. An alternative way to assemble screen 10 is to attach the screen material 14 to the base pipe 12 in the manner just described and then to cure the conforming layer 16 right onto the screen material 14. As another option a protective outer jacket (not shown) can be applied over screen material 14 and the conforming layer 16 mounted above. The joining process even with the optional perforated protective jacket (not shown) is the outward expansion from within the base pipe 12, as previously described.

Figure 2:
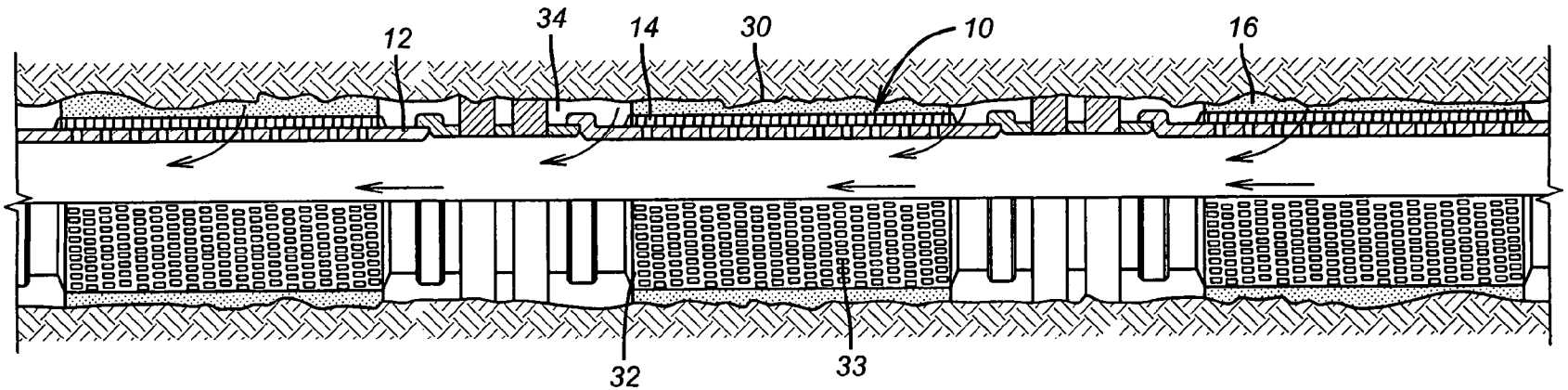
FIG. 2 is a section view of an assembly of screens, one of which is shown in FIG. 1, in the expanded position downhole.

The holes 18 can have a variety of shapes. Their function is to allow formation fluids to pass after expansion. They can be round holes or slots or other shapes or combinations of shapes. The conforming layer 16 can be made of a polymeric material and is preferably one that swells on sustained exposure to well fluids to better conform to irregular shapes in the borehole 30, as shown in FIG. 2. FIG. 2 also shows the outer protective jacket 32 that goes over screen material 14 and below conforming layer 16 to protect the screen material 14 when run into the borehole 30. Jacket 32 is a known product that has punched openings 33 and can optionally be used if the conforming layer 16 is used. The reason it is optional is that the conforming layer 16 to some degree provides the desired protection during run in. Additionally, without jacket 32, the conforming layer 16 can be made thicker to better fill in void volume 34 in the annular space around a screen 10 after expansion. The thickness of the conforming layer 16 is limited by the borehole and the outer diameter of the components mounted inside of it. It is preferred that the conforming layer 16 be squeezed firmly as that promotes its movement to fill voids in the surrounding annular space.

Those skilled in the art will appreciate that the present invention allows for fabrication of an expandable screen with welds between layers eliminated. The use of the conforming material 16 allows a variety of expansion techniques to be used and an improvement of the ability to eliminate void spaces outside the expanded screen caused by borehole irregularities. Alternatively, the conforming material 16 can swell sufficiently without downhole expansion of the screen 10 to allow for the elimination of the need to gravel pack. If the material swells due to exposure to fluids downhole, its use as the conforming layer 16 is desired. A protective jacket 32 under the conforming layer 16 may be used to protect the screen material 14 during run in.

The foregoing disclosure and description of the invention are illustrative and explanatory thereof, and various changes in the size, shape and materials, as well as in the details of the illustrated construction, may be made without departing from the spirit of the invention.

I claim:

1. A well completion method, comprising:

covering at least one opening on a tubular with an unrestrained conforming material said conforming material made of at least one segment;

running said tubular to a desired location in the wellbore;

allowing said unrestrained conforming material to enlarge into substantial contact with the wellbore;

taking flow through said at least one segment of said conforming material and then through said opening in said tubular after allowing said unrestrained conforming material to enlarge into contact with the wellbore.

2. The method of claim 1, comprising:

allowing said conforming material to enlarge to the shape of the surrounding wellbore.

3. The method of claim 1, comprising:

securing said conforming material to said tubular as a result of bonding.

4. The method of claim 2, comprising:

expanding said tubular and conforming material;

forcing said conforming material to flow along the wellbore by said expanding of said tubular.

5. The method of claim 1, comprising:

allowing said conforming material to swell.

6. The method of claim 5, comprising:

using well fluids to initiate said swelling.

7. The method of claim 1, comprising:

using a polymeric material as said conforming material.

8. A well completion method, comprising:

covering a tubular having at least one opening with an unrestrained conforming material;

running said tubular to a desired location in the wellbore;

allowing said unrestrained conforming material to enlarge;

securing said conforming material to said tubular by outward expansion of said tubular prior to said running said tubular into the wellbore.

9. A well completion method, comprising:

covering at least one opening on a tubular with a conforming material said conforming material made of at least one segment, said conforming material having a relaxed outer dimension in an unrestrained condition;

running said tubular to a desired location in the wellbore;

allowing said conforming material to enlarge beyond said relaxed outer dimension into substantial contact with the wellbore;

taking flow through said said at least one segment of said conforming material and then through said opening in said tubular after allowing said conforming material to enlarge into contact with the wellbore.

10. The method of claim 9, comprising:

using a polymeric material as said conforming material.

11. The method of claim 9, comprising:

allowing the conforming material to swell.

12. The method of claim 11, comprising:

using well fluids to initiate said swelling.

13. The method of claim 9, comprising:

expanding said tubular and conforming material;

forcing said conforming material to flow along the wellbore by said expanding of said tubular.

14. The method of claim 9, comprising:

allowing said conforming material to enlarge to the shape of the surrounding wellbore.

15. A well completion method, comprising:

covering a tubular having at least one opening with a conforming material, said conforming material having a relaxed outer dimension in an unrestrained condition;

running said tubular to a desired location in the wellbore;

allowing said conforming material to enlarge beyond said relaxed outer dimension;

securing said conforming material to said tubular by outward expansion of said tubular prior to said running said tubular into the wellbore.

* * * * *